US008886087B2

(12) United States Patent
Wu et al.

(10) Patent No.: US 8,886,087 B2
(45) Date of Patent: Nov. 11, 2014

(54) PHOTOSENSITIVE DRUM DRIVING HEAD AND DRIVING MECHANISM OF IMAGE FORMING APPARATUS

(71) Applicant: Zhuhai Seine Technology Co., Ltd., Zhuhai (CN)

(72) Inventors: Junzhong Wu, Zhuhai (CN); Qingfei Peng, Zhuhai (CN); Jianxin Cao, Zhuhai (CN); Jinlian Liu, Zhuhai (CN)

(73) Assignee: Zhuhai Seine Technology Co., Ltd., Guangdong (CN)

( * ) Notice: Subject to any disclaimer, the term of this patent is extended or adjusted under 35 U.S.C. 154(b) by 0 days.

(21) Appl. No.: 13/972,739

(22) Filed: Aug. 21, 2013

(65) Prior Publication Data

US 2014/0010576 A1 Jan. 9, 2014

Related U.S. Application Data

(63) Continuation of application No. PCT/CN2012/086505, filed on Dec. 13, 2012.

(30) Foreign Application Priority Data

Jul. 5, 2012 (CN) ..... 2012 1 0232590

(51) Int. Cl.
*G03G 15/00* (2006.01)

(52) U.S. Cl.
CPC ..... *G03G 15/751* (2013.01); *G03G 15/757* (2013.01); *G03G 2221/1657* (2013.01)
USPC ..... 399/117; 399/167

(58) Field of Classification Search
CPC ..... G03G 15/751; G03G 15/757; G03G 21/1647; G03G 2221/1606; G03G 2221/1657
USPC ..... 399/117, 167
See application file for complete search history.

(56) References Cited

U.S. PATENT DOCUMENTS

| | | | | |
|---|---|---|---|---|
| 4,975,743 | A * | 12/1990 | Surti | 399/111 |
| 6,175,706 | B1 * | 1/2001 | Watanabe et al. | 399/167 |
| 6,501,927 | B1 * | 12/2002 | Watanabe et al. | 399/117 |
| 6,768,890 | B2 * | 7/2004 | Cho et al. | 399/167 |

(Continued)

FOREIGN PATENT DOCUMENTS

| | | |
|---|---|---|
| CN | 201110946 Y | 9/2008 |
| CN | 202394037 U | 8/2012 |

(Continued)

*Primary Examiner* — David Gray
*Assistant Examiner* — Carla Therrien
(74) *Attorney, Agent, or Firm* — J.C. Patents

(57) ABSTRACT

The invention relates to a photosensitive drum driving head, which comprises drum flange, drum shaft and boss, wherein the drum flange is disposed on the end portion of a photosensitive drum and connected with the photosensitive drum; the drum shaft is axially extended from the end portion of the drum flange; the boss is axially extended from the end face of the drum shaft and engaged with a recess in a driving head of image forming apparatus; three vertical convex teeth radially extended along the boss and engaged with power transmission portions are formed on side wall of the boss, perpendicular to the drum shaft, extended along an axial line of the photosensitive drum, and provided with mating surfaces formed by longitudinal cutting angles on end faces of the vertical convex teeth; at least one mating surface is engaged with an edge of a twisted bevel of the recess.

12 Claims, 26 Drawing Sheets

(56) References Cited

U.S. PATENT DOCUMENTS

| | | | | |
|---|---|---|---|---|
| 6,892,042 | B2 * | 5/2005 | Jang et al. | 399/167 |
| 7,236,722 | B2 * | 6/2007 | Portig | 399/167 |
| 7,433,631 | B2 * | 10/2008 | Karz et al. | 399/167 |
| 7,437,098 | B2 * | 10/2008 | Kim et al. | 399/167 |
| 7,537,410 | B2 * | 5/2009 | Parisi et al. | 403/383 |
| 7,813,676 | B2 * | 10/2010 | Huck et al. | 399/167 |
| 8,073,364 | B2 * | 12/2011 | Huck et al. | 399/167 |
| 8,275,291 | B2 * | 9/2012 | Jin | 399/167 |
| 8,311,455 | B2 * | 11/2012 | Tsui | 399/167 |
| 8,538,295 | B2 * | 9/2013 | Huck et al. | 399/167 |
| 2008/0138113 | A1 * | 6/2008 | Murrell et al. | 399/167 |
| 2009/0074453 | A1 | 3/2009 | Noda et al. | 399/111 |
| 2010/0303501 | A1 * | 12/2010 | Tsui | 399/167 |
| 2013/0183063 | A1 * | 7/2013 | Huck et al. | 399/167 |
| 2013/0236211 | A1 * | 9/2013 | Lee et al. | 399/159 |

FOREIGN PATENT DOCUMENTS

| | | | |
|---|---|---|---|
| CN | 102866608 | A | 1/2013 |
| CN | 102866609 | A | 1/2013 |
| JP | 2003-186348 | A | 7/2003 |

* cited by examiner

PHOTOSENSITIVE DRUM DRIVING HEAD AND DRIVING MECHANISM OF IMAGE FORMING APPARATUS

CROSS-REFERENCE TO RELATED APPLICATIONS

This application is a continuation of International Application No. PCT/CN2012/086505, filed on Dec. 13, 2012, which claims the priority benefit of China Patent Application No. 201210232590.1, filed on Jul. 5, 2012. The contents of the above identified applications are incorporated herein by reference in their entirety.

FIELD OF THE TECHNOLOGY

The invention relates to a photosensitive drum driving head and a driving mechanism for an image forming apparatus.

BACKGROUND

The traditional, image forming apparatus comprises a motor, a driving head for an image forming apparatus and a process cartridge, wherein the process cartridge is detachably mounted in the image forming apparatus and provided with a photosensitive drum and a photosensitive drum driving head fixedly connected to the end portion of the photosensitive drum. During the operation of the image forming apparatus, the power is generated by the motor and transmitted to the process cartridge via the engagement between the driving head for the image forming apparatus and the photosensitive drum driving head, so as to make the photosensitive drum on the process cartridge rotate.

As illustrated in FIGS. 1 and 2, the photosensitive drum driving head is fixedly arranged at one end of a photosensitive drum 7 and comprises a convex connection shaft 17 provided with a twisted projection 17*a* having an end surface 17*a*1; a rotation center of the convex connection shaft 17 and a rotation center of the photosensitive drum 7 are aligned; and a concave connection shaft 18 comprise a twisted recess 18*a* and a bottom surface 18*a*1 is provided on the recess 18*a*.

During the operation of the image forming apparatus, the driving head 18 for the image forming apparatus receives the rotary power from the motor; the convex connection shaft 17 is engaged with the driving head 18 for the image forming apparatus; and the rotary power is transmitted to the convex connection shaft 17 through the driving head 18 of the image forming apparatus and finally makes the photosensitive drum rotate. When the convex connection shaft 17 is engaged with the driving head 18 of the image forming apparatus, the twisted projection 17*a* on the convex connection shaft 17 is interposed into the twisted recess 18*a* in the driving head 18 of the image forming apparatus; the end face 17*a*1 is directly opposite to the bottom surface 18*a*2; and the rotary power on the driving head 18 of the image forming apparatus is transmitted to the convex connection shaft 17 via the engagement between the twisted projection 17*a* and the recess 18*a*.

FIGS. 3 and 4 are sectional views respectively illustrating the state when the twisted projection 17*a* and the twisted recess 18*a* do not rotate and rotate. As shown in the figures, both cross sections of the twisted projection 17*a* and the twisted recess 18*a* take the shape of triangles (such as equilateral triangles), and the dimension of the triangular projection 17*a* is less than that of the triangular recess 18*a*. As illustrated in FIG. 3, when the projection 17*a* is interposed into the recess 18*a* but does not rotate along with the recess 18*a*, a rotation axis X1 of the convex connection shaft on the photosensitive drum is not aligned with a rotation axis X2 of the driving head of the image forming apparatus. As illustrated in FIG. 4, when the projection 17*a* is engaged with the recess 18*a* and rotates along with the recess 18*a*, three vertex angles 17*a*2 of the triangular projection 17*a* are engaged with three edges of the triangle on the recess 18*a*, and the power is transmitted to the twisted projection 17*a* from the recess 18*a*, and the rotation axis X1 of the convex connection shaft on the photosensitive drum is aligned with the rotation axis X2 of the driving head of the image forming apparatus, so that the stable transmission between the twisted projection 17*a* and the twisted recess 18*a* during the operation can be guaranteed. In the figure, R0 refers to the diameter of a rotation circle of the three vertex angles 17*a*2 of the projection 17*a*; R1 refers to the diameter of an inscribed circle of the triangular recess 18*a*; and R2 refers to the diameter of a rotation circle of three vertex angles of the recess 18*a*. In order to achieve the power transmission between the twisted projection 17*a* and the recess 18*a* of the image forming apparatus, R0, R1 and R2 must satisfy the condition of $R1<R0<R2$.

FIG. 5 illustrates another embodiment of the prior art. In the embodiment, both the twisted projection 17*a* and the twisted recess 18*a* take the shape of quadrilaterals (such as squares) and are engaged with each other for power transmission.

In the prior art, the driving head of the image forming apparatus may also adopt the mode as illustrated in FIG. 6. As illustrated in FIG. 6, a twisted recess 28*a* is formed at one end of a driving head 28 of the image forming apparatus and provided with a bottom surface 28*a*1 and a projection 28*a*2 which is disposed at the center of the twisted triangular recess 28*a* (a rotation center of the boss is aligned with a rotation axis X2 of the driving head of the image forming apparatus). In addition, the height of the projection 28*a*2 is substantially the same with the depth of the recess 28*a*, and the projection may be conical.

The photosensitive drum with the photosensitive drum driving head is widely used in a process cartridge for the traditional image forming apparatus. The process cartridge at least comprises a photosensitive drum, a developer and a developing roller, wherein the photosensitive drum used for forming an electrostatic latent image is provided with the photosensitive drum driving head; the developer is used for developing the electrostatic latent image; and the developing roller is used for transmitting the developer to the photosensitive drum. When the process cartridge is mounted into the image forming apparatus for use, the rotary power from the motor of the image forming apparatus is received by the driving head of the image forming apparatus, so as to make the photosensitive drum and the developing roller rotate.

The power transmission structure in the prior art has the defects that:

1. When the twisted projection is engaged with the twisted recess, the twist angles of twisted surfaces on the projection and the recess ask for high accuracy. In the case of inconsistent twist angles of the twisted surfaces on the projection and the recess due to the problem of the manufacturing accuracy, the twisted surface on the projection makes point-to-surface contact with the twisted surface on the recess, and one of the twisted surfaces may be deformed during the engagement between the projection and the recess, so that the rotation axis X1 of the convex connection shaft on the photosensitive drum cannot be aligned with the rotation axis X2 of the driving head for the image forming apparatus, and hence the stability of power transmission may be affected. In order to avoid the above problem, the manufacturing accuracy of the twisted surfaces of the projection and the recess must be very high, and thus the manufacturing cost can be increased and the problems of difficult manufacturing and the like can be caused.

2. As the polygonal shapes of the projection and the recess are difficult to process, the projection and the recess ask for high manufacturing accuracy. Taking an equilateral triangle for example, the accuracy of centers of triangles can only be guaranteed under the condition of high accuracy requirement on the equilateral triangle projection and the equilateral triangle recess, or else, the rotation axis X1 of the convex connection shaft on the photosensitive drum may be not aligned with the rotation axis X2 of the driving head for the image forming apparatus when the projection and the recess are engaged with each other, so that the instable transmission may be caused. Moreover, during the engagement between the projection and the recess, the vertex angles of the triangle on the projection, for the reason of power transmission, tend to be deformed due to the application of force and are vulnerable to wear or damage during long term operation. Furthermore, the three vertex angles of the triangle simultaneously have the functions of rotating due to the application of force and supporting and positioning during the operation, so that the centers X1 and X2 tend to be not aligned with each other during the engagement between the worn or damaged triangle and the recess, and thus the transmission stability may be affected. Therefore, in order to guarantee the accuracy and stability of transmission, the requirements on the hardness and wear resistance of materials of the triangular projection are very high. Similarly, the positions, making contact with the three vertex angles of the projection, on the edges of the triangular recess are also vulnerable to wear or damage during the operation, so that the requirements on the hardness and wear resistance of the triangular recess are also high.

SUMMARY

The invention provides a photosensitive drum driving head and a driving mechanism for an image forming apparatus to solve the technical problem of high accuracy requirement on the twist angles of a twisted projection and a twisted recess of the traditional photosensitive drum driving head due to the engagement between the twisted projection and the twisted recess.

In order to solve the technical problem, the invention adopts the technical proposal that:

The invention relates to a photosensitive drum driving head, engaged with a driving head of an image forming apparatus for power transmission, the driving head of the image forming apparatus comprising a twisted recess having a triangular cross section, and a power transmission portion respectively arranged inside three vertex angles of the twisted recess and provided with a twisted bevel on the top of which an edge engaged with the photosensitive drum driving head is formed, characterized in that the photosensitive drum driving head comprises a drum flange, a drum shaft, a boss and three vertical convex teeth, wherein the drum flange is disposed on the end portion of a photosensitive drum and connected with the photosensitive drum; the drum shaft is axially extended from the end portion of the drum flange; the boss is axially extended from the end face of the drum shaft and engaged with a recess in the driving head of the image forming apparatus; the three vertical convex teeth which are radially extended along the boss and engaged with the power transmission portions are formed on the side wall of the boss, perpendicular to the drum shaft, extended along an axial line of the photosensitive drum, and provided with mating surfaces which are formed by longitudinal cutting angles of end faces of the vertical convex teeth; and at least one mating surface is engaged with the edge on the twisted bevel of the recess for power transmission.

The vertical convex tooth has a first side face and a second side face which are parallel to each other and perpendicular to the end face of the drum shaft.

The vertical convex tooth also has a first side face and a second side face, wherein the first side face is perpendicular to the end face of the drum shaft; the second side face is obliquely arranged; and the width of the vertical convex tooth is gradually increased towards the root of the vertical convex tooth along the end face of the vertical convex tooth.

By adoption of the technical proposal, the convex teeth, engaged with the power transmission portions, of the photosensitive drum driving head are configured to be vertical teeth. Therefore, the technical problem of high accuracy requirement on the twist angles of the twisted boss and the twisted recess of the traditional photosensitive drum driving head due to the engagement between the twisted boss and the twisted recess can be solved.

BRIEF DESCRIPTION OF THE DRAWINGS

FIG. 24(*b*) is a sectional view of FIG. 24(*a*) along the C direction.

DETAILED DESCRIPTION

Embodiment 1

Figure 1:
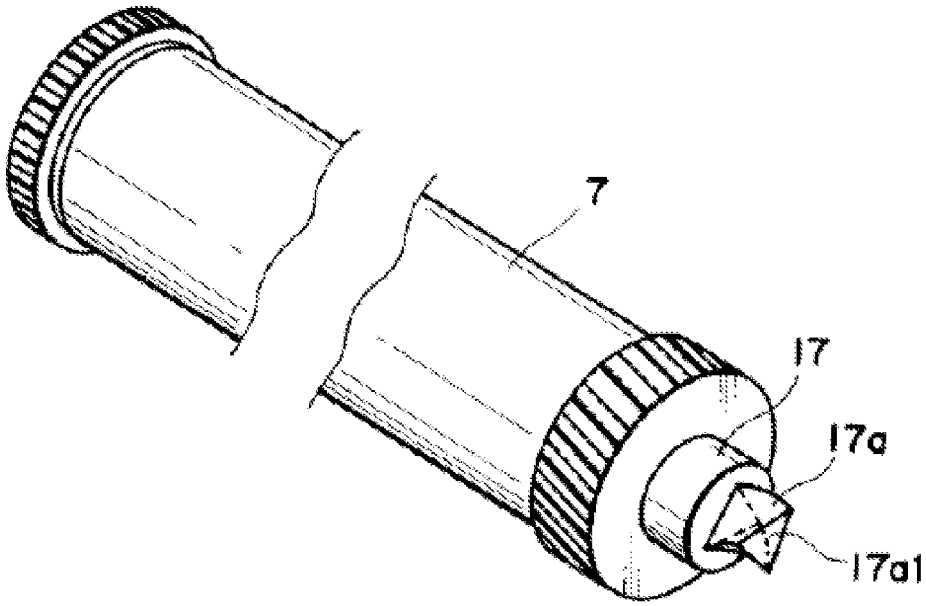
FIG. 1 (PRIOR ART)
FIG. 1 is a perspective view of a photosensitive drum with a photosensitive drum driving head in the prior art.
Figure 2:
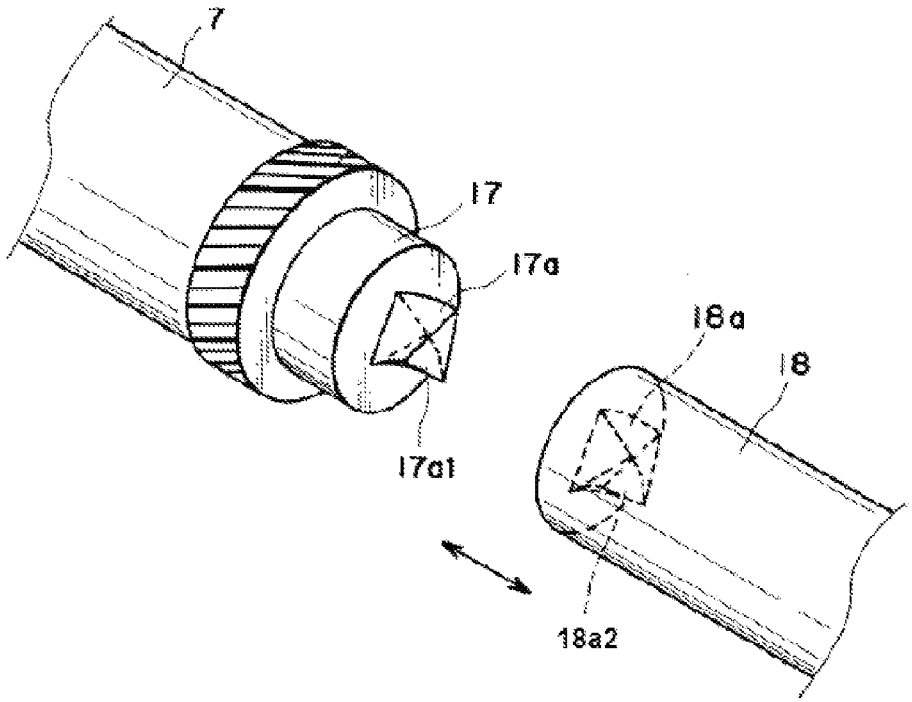
FIG. 2 (PRIOR ART)
FIG. 2 is a perspective view of a convex connection shaft and a concave connection shaft in the prior art.
Figure 3:
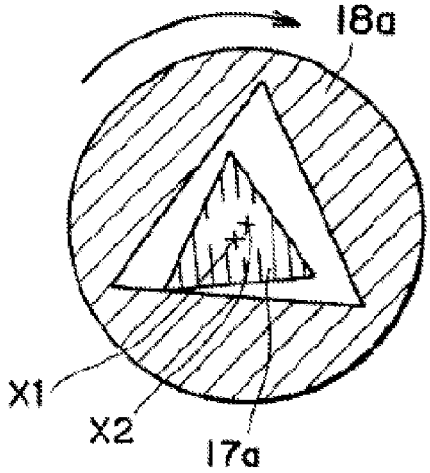
FIG. 3 (PRIOR ART)
FIG. 3 is a sectional view illustrating the state when a twisted projection and a twisted recess in the prior art do not rotate.
Figure 4:
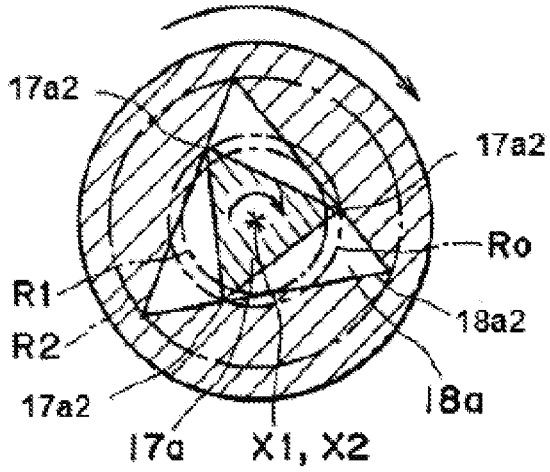
FIG. 4 (PRIOR ART)
FIG. 4 is a sectional view illustrating the state when the twisted projection and the twisted recess in the prior art rotate.
Figure 5:
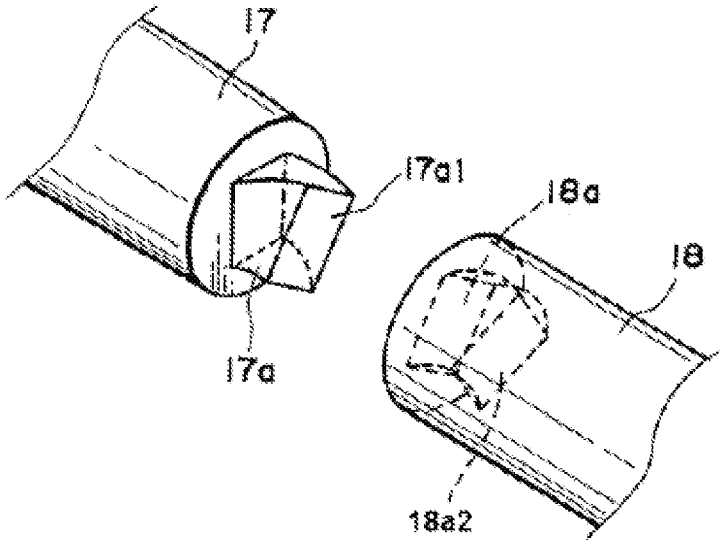
FIG. 5 (PRIOR ART)
FIG. 5 is a perspective view of a quadrilateral projection and a quadrilateral recess in another embodiment of the prior art.
Figure 6:
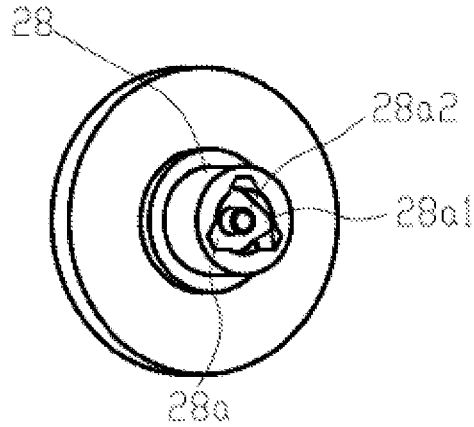
FIG. 6 (PRIOR ART)
FIG. 6 is a schematic diagram illustrating the state when the projection is disposed at the center of the recess in the prior art.
Figure 7:
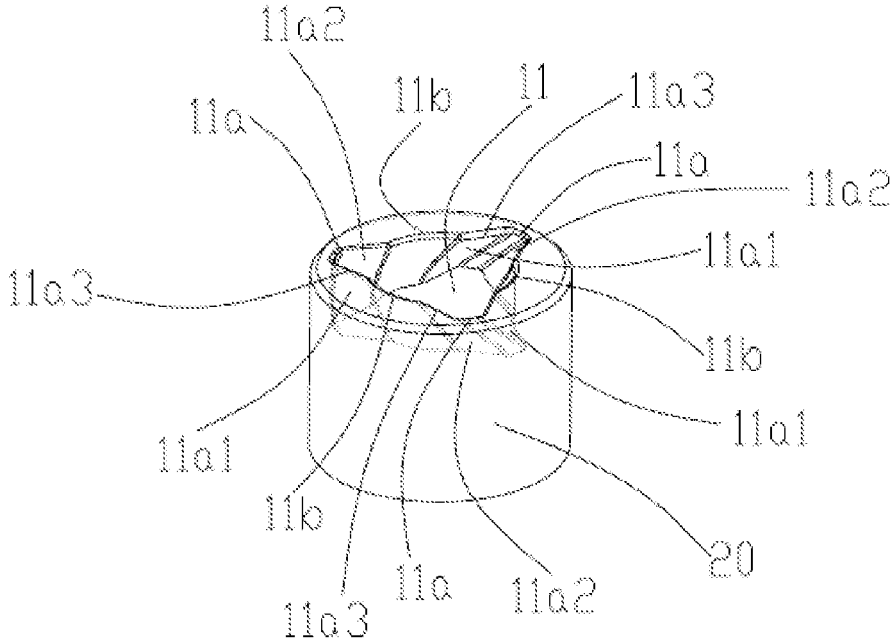
FIG. 7 is a perspective view of a driving head of an image forming apparatus.
Figure 8:
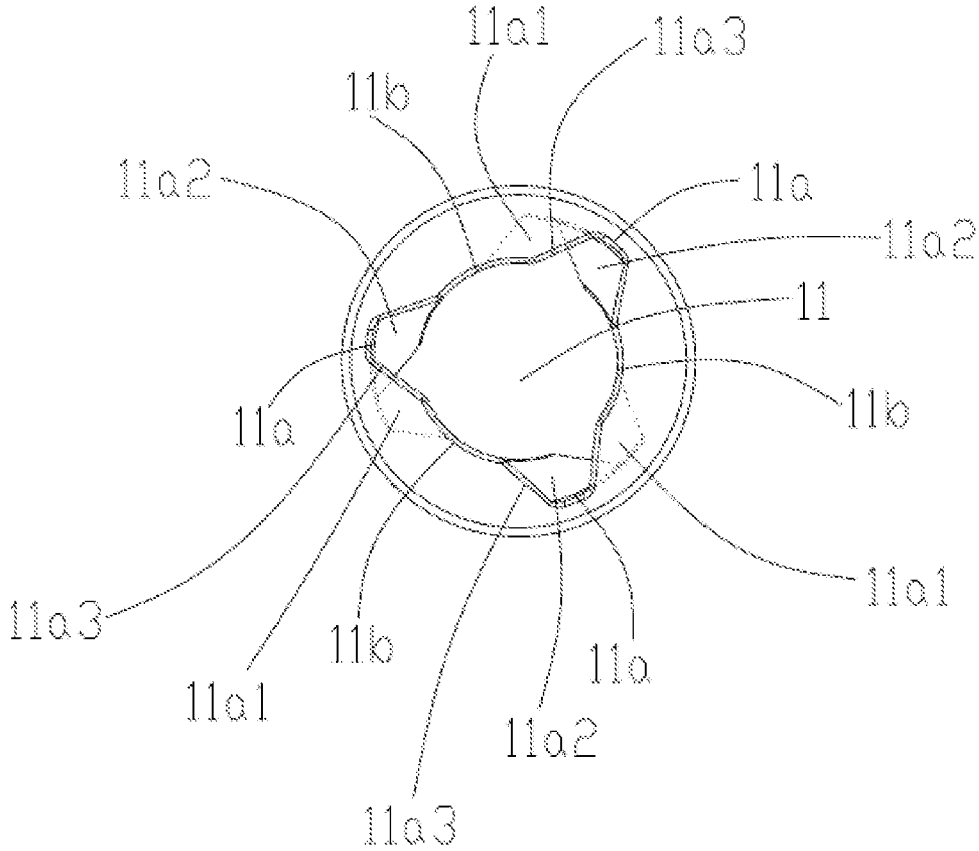
FIG. 8 is a top view of the driving head of the image forming apparatus.

FIGS. 7 and 8 are respectively a perspective view and a top view of a driving head of an image forming apparatus. As shown in the figures, the driving head 20 of the image forming apparatus comprises a recess 11, power transmission portions 11*a* and retainer portions 11*b*, wherein the recess 11 has an equilateral triangle cross section; the power transmission portions 11*a* are arranged at three vertex angles of the triangle and have twisted structures; the retainer portions 11*b* are disposed on three edges of the triangle; and the power transmission portions 11*a* are provided with twisted bevels 11*a*1 and guide bevels 11*a*2. As shown in the top view of FIG. 7, the twisted bevels 11*a*1 are invisible; the included angle between the twisted bevels 11*a*1 and a bottom surface of the recess is less than 90 DEG; edges 11*a*3 are formed on the top of the twisted bevels 11*a*1; the guide bevels 11*a*2 are visible; and the included angle between the guide bevels 11*a*2 and the bottom surface of the recess is more than 90 DEG. Moreover, the driving head of the image forming apparatus is connected with a motor in the image forming apparatus to transmit power.

The driving head 20 of the image forming apparatus is the same with that the driving head of the image forming apparatus in the prior art.

Figure 9:
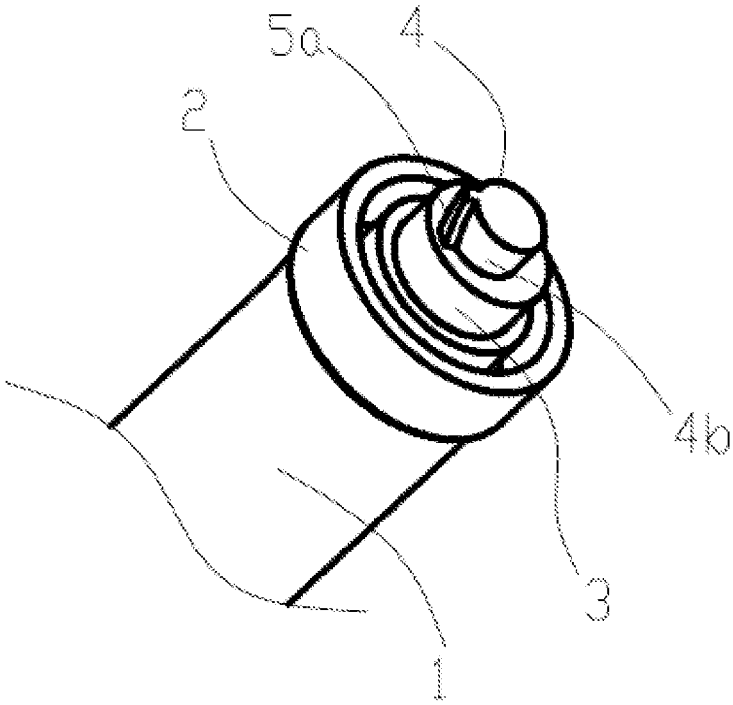
FIG. 9 is a perspective view of a photosensitive drum driving head in an embodiment 1.

FIG. 9 is a perspective view of a photosensitive drum driving head in the embodiment 1. As shown in the figure, the photosensitive drum driving head comprises a drum flange 2, a drum shaft 3 and a boss 4, wherein the drum flange 2 is disposed on the end portion of a photosensitive drum 1, connected with the photosensitive drum 1 and used for transmitting the received power to the photosensitive drum 1; the drum shaft 3 is axially extended from the end portion of the drum flange 2 and used for rotationally supporting the photosensitive drum 1 during the operation of a process cartridge; the boss 4 is axially extended from the end face of the drum shaft 3 and used for receiving the power from the driving head 20 of the image forming apparatus; and a first convex teeth 5*a* radially extended along the boss 4 is formed on a side wall 4*b* of the boss 4. More specifically, the first convex tooth 5*a* is obliquely formed on the side wall 4*b* of the boss.

During the power transmission, the first convex tooth 5*a* on the boss 4 of the photosensitive drum driving head is engaged with any power transmission portion 11*a* for power transmission. Moreover, the side wall 4*b* of the boss of the photosensitive drum driving head is tangential to and engaged with the retainer portions 11*b* of the recess of the driving head of the image forming apparatus at three tangential points P1, P2 and P3, so that the center alignment between the photosensitive drum driving head and the driving head 20 of the image forming apparatus during the power transmission can be achieved.

Figure 10:
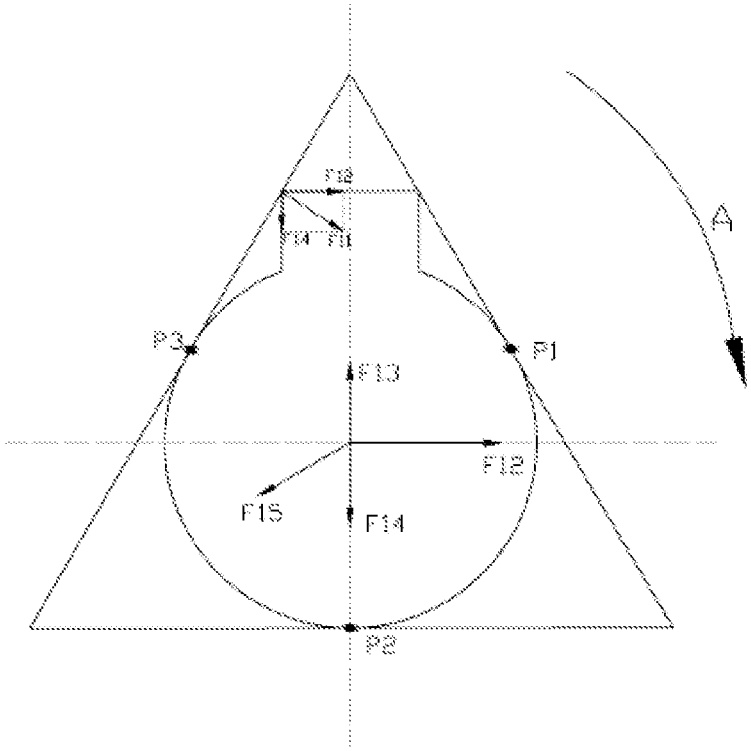
FIG. 10 is a force diagram illustrating the assembly of the photosensitive drum driving head in the embodiment 1 and the driving head of the image forming apparatus.

FIG. 10 is a force diagram illustrating the assembly of the photosensitive drum driving head and the driving head of the image forming apparatus. "A" refers to the rotation direction of the driving head for the image forming apparatus; F11 refers to the force applied to the first convex tooth 5*a* by the driving head of the image forming apparatus and is resolved into a normal force F12 and a radial force F14; F15 refers to the force applied to the driving head for the image forming apparatus at the tangential point P1; F13 refers to the force applied to the driving head for the image forming apparatus at the tangential point P2; and no force is applied at the tangential point P3. In summary, the following force formulas can be obtained:

$$\begin{cases} F13 = F14 + F15 \cdot \sin 30^\circ \\ F12 = F15 \cdot \sin 60^\circ \\ F12 = \sqrt{3} \cdot F14 \end{cases}$$

Hence, F13=2·F14 and $$F15 = \frac{2\sqrt{3}}{3} F12.$$

That is to say, the force of $$\frac{2\sqrt{3}}{3} F12$$

is applied to the driving head of the image forming apparatus or the photosensitive drum driving head at the tangential point P1, and the force of 2·F14 is applied to the driving head of the image forming apparatus or the photosensitive drum driving head at the tangential point P2.

Due to mutual wear between the photosensitive drum driving head and the driving head of the image forming apparatus during the engagement and power transmission, in the proposal, the convex teeth, engaged with the power transmission portions, and a cylindrical surface of a boss, taken as a positioning portion, of the photosensitive drum driving head, are disposed at different positions, so that the functions of power transmission and positioning cannot be affected by each other due to wear.

Embodiment 2

Figure 11:
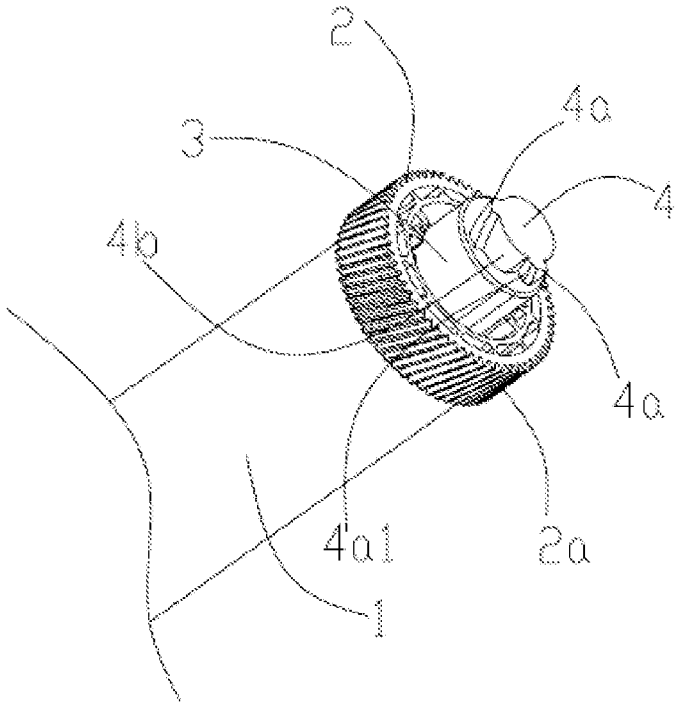
FIG. 11 is a perspective view of a photosensitive drum driving head in an embodiment 2.
Figure 12:
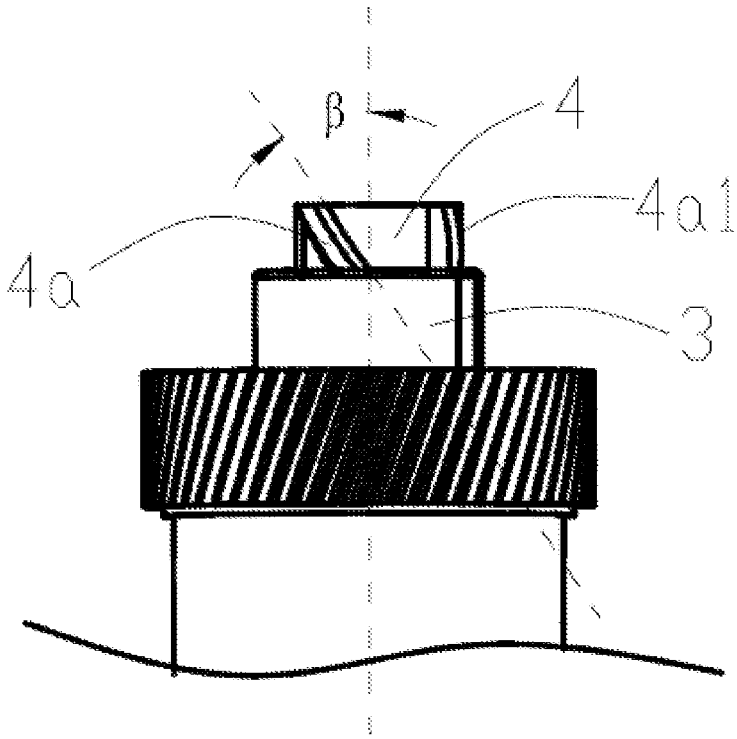
FIG. 12 is a front view of the photosensitive drum driving head in the embodiment 2.
Figure 13:
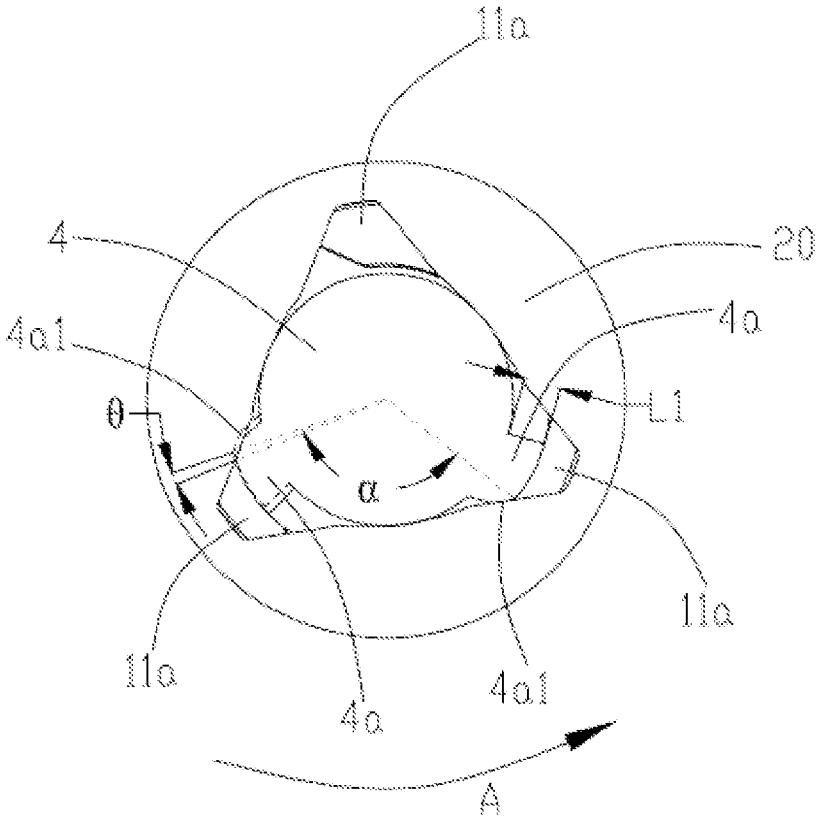
FIG. 13 is a top view illustrating the assembly of the photosensitive drum driving head in the embodiment 2 and the driving head of the image forming apparatus.

FIGS. 11 and 12 are respectively a perspective view and a front view of a photosensitive drum driving head in the embodiment, and FIG. 13 is a top view illustrating the assembly of the photosensitive drum driving head in the embodiment and a driving head of an image forming apparatus. The driving head for the image forming apparatus in the embodiment adopts the driving head for the image forming apparatus in the embodiment 1 and will not be described further. As shown in the figures, the photosensitive drum driving head comprises a drum flange 2, a drum shaft 3 and a cylindrical boss 4, wherein the drum flange 2 is fixedly connected to the end portion of a photosensitive drum 1; the drum shaft 3 is axially extended from the end portion of the drum flange 2 and used for rotationally supporting the photosensitive drum 1 during the operation of a process cartridge; the cylindrical boss 4 is axially extended from the end face of the drum shaft 3 and used for receiving power from the driving head 20 of the image forming apparatus; and a pair of convex teeth 4*a*, which are radially extended along the cylindrical boss 4 and engaged with any two power transmission portions in the driving head of the image forming apparatus, are formed on a side wall 4*b* of the cylindrical boss 4. More specifically, the convex teeth 4*a* are obliquely formed on the side wall 4*b* of the cylindrical boss 4. In addition, the convex teeth 4*a* are provided with mating surfaces 4*a*1, and the area of the mating surfaces 4*a*1 is between 5 and 20 $mm^2$ and preferably between 7 and 16 $mm^2$ During the power transmission, the mating surfaces 4*a*1 are engaged with inner walls of the power transmission portions in the driving head of the image forming apparatus to transmit power. By arrangement of the mating surfaces 4*a*1 on the convex teeth 4*a*, the wear between the photosensitive drum driving head and the driving head of the image forming apparatus can be reduced. The included angle β between the convex teeth 4*a* and a rotation axis of the photosensitive drum driving head is between 3 and 40 degrees and preferably between 25 and 30 degrees, so that smooth engagement between the photosensitive drum driving head and the driving head of the image forming apparatus can be guaranteed and meanwhile the phenomenon that the photosensitive drum driving head is disengaged from the driving head of the image forming apparatus during the power transmission can be prevented, and thus the stable power transmission between the driving head of the image forming apparatus and the photosensitive drum driving head can be achieved. L1 refers to the length of the convex teeth 4*a* beginning from the side wall 4*b* along the radial direction and is between 2 and 5 mm and preferably between 2.3 and 3.3 mm, so that guarantee is made that the photosensitive drum driving head has sufficient moment for power transmission. The minimum included angle α between the two convex teeth 4*a* has a standard angle of 120 degrees, and the upper limit angle tolerance is generally within 2 degrees. In the proposal, the convex teeth 4*a* are allowed to have the manufacturing accuracy error θ, which is between 2 and 10 degrees and preferably between 2 and 4 degrees. If θ refers to angular error, the minimum included angle α between the two convex teeth 4*a* is converted into α+θ. At this point, the two convex teeth 4*a* may not be engaged with the power transmission portions 11*a* of the recess 11 at the same time, and the convex tooth disposed on the upmost upstream of the rotation direction is engaged with the power transmission portion on the driving head of the image forming apparatus first and has the function of buffering. If the convex teeth 4*a* have the manufacturing error of 0 along the downstream of the rotation direction, a graded mating surface may be formed on each convex tooth and has the function of buffering the convex tooth 4*a* during the engagement between the convex tooth 4*a* and the power transmission portion 11*a* of the recess, and hence the damage between the driving head of the image forming apparatus and the photosensitive drum driving head can be reduced. In addition, a boss cylindrical surface between the two convex teeth 4*a* makes contact with the retainer portions 11*b* of the driving head of the image forming apparatus to achieve the positioning of the photosensitive drum driving head. Moreover, round angles are also formed at joints of the convex teeth 4*a* and the boss cylindrical surface to reduce stress concentration. Furthermore, the drum flange 2, the drum shaft 2, the cylindrical boss 4 and the convex teeth 4*a* of the photosensitive drum driving head may be integrally formed by the same material and may also have buffer structures, and the drum flange 2 may also be provided with a drum gear 2*a* used for transmitting the power to other elements (such as a developing element).

Figure 14:
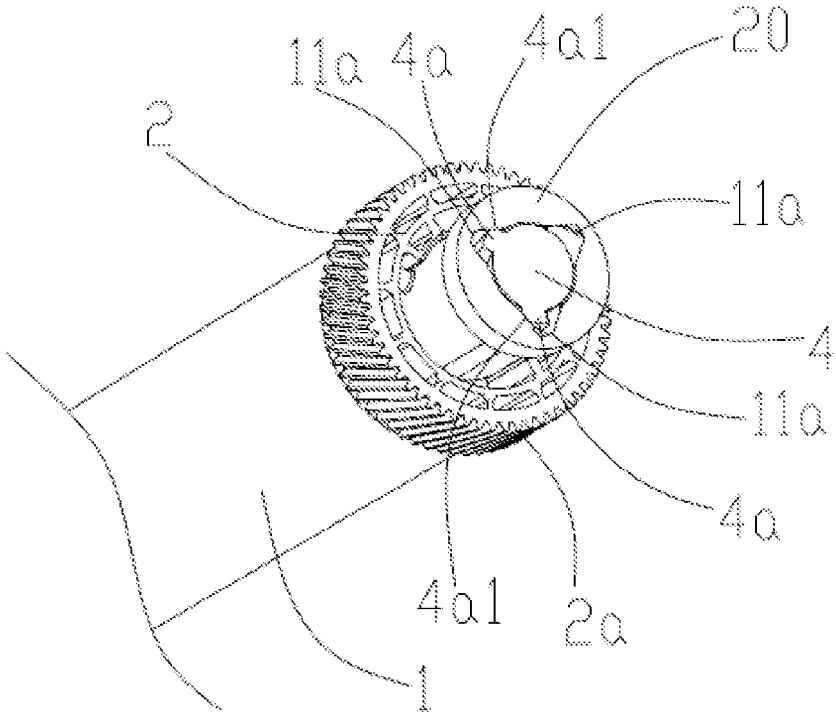
FIG. 14 is a schematic diagram illustrating the assembly of the photosensitive drum driving head in the embodiment 2 and the driving head of the image forming apparatus.
Figure 15:
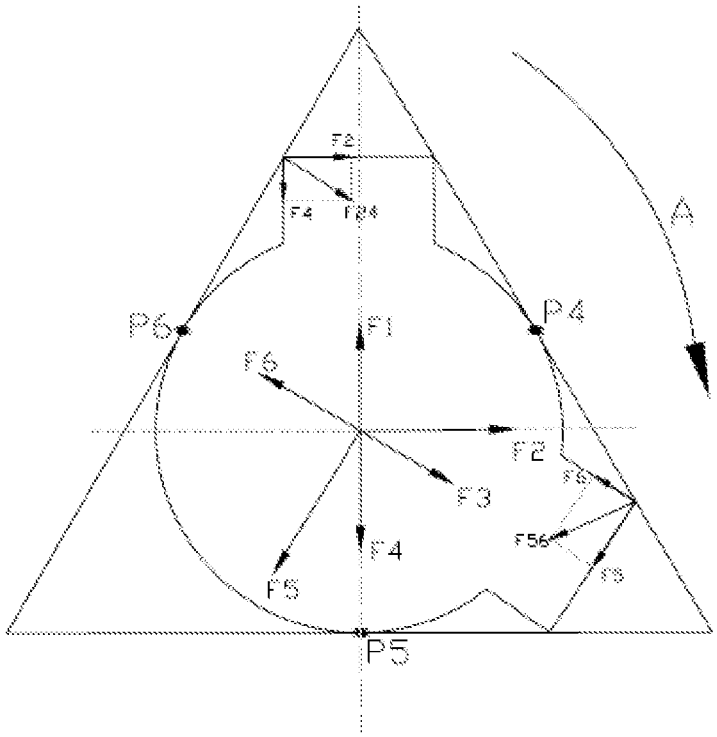
FIG. 15 is a force diagram illustrating the state after the engagement between the photosensitive drum driving head in the embodiment 2 and the driving head of the image forming apparatus.

FIG. 14 is a schematic diagram illustrating the assembly of the photosensitive drum driving head and the driving head of the image forming apparatus, and FIG. 15 is a force diagram illustrating the state after the engagement of the driving head of the image forming apparatus and the photosensitive drum driving head. As shown in the figures, the photosensitive drum driving head is tangential to and engaged with the retainer portions 11*b* of the recess of the driving head for the image forming apparatus at three tangential points P4, P5 and P6. "A" refers to the rotation direction of the driving head for the image forming apparatus; forces F24 and F56 which are the same with each other are applied to the photosensitive drum driving head by the driving head of the image forming apparatus; when the torsional moment born by the photosensitive drum driving head is twice that in the embodiment 1, F24 and F56 are the same with F11 in the embodiment 1; F24 is resolved into a normal force F2 and a radial force F4; F56 is resolved into a normal force F5 and a radial force F6; F2 and F5 are the same with F12 in the embodiment 1; and F4 and F6 are the same with F14 in the prior art. Supposing that is the force applied to the driving head of the image forming apparatus at the tangential point P5, F3 is the force applied to the driving head of the image forming apparatus at the tangential point P6, and no force is applied at the tangential point P4, the following force formulas can be obtained:

$$\begin{cases} F1 + F6 \cdot \sin 30^\circ = F4 + F5 \cdot \sin 60^\circ + F3 \cdot \sin 30^\circ \\ F2 + F3 \cdot \sin 60^\circ = F6 \cdot \sin 60^\circ + F5 \cdot \sin 30^\circ \\ F2 = F5 = \sqrt{3}\, F4 = \sqrt{3}\, F6 \end{cases}$$

Hence, F1=2·F4 and F3=0. That is to say, the force of 2·F4 is applied to the driving head of the image forming apparatus and the photosensitive drum driving head at P5 and the force of 0 is applied to the driving head for the image forming apparatus and the photosensitive drum driving head at P6. Compared with the embodiment 1, the number of the force points of the proposal is reduced, so that the wear of the driving head of the image forming apparatus and the photosensitive drum driving head at the tangential points P5 and P6 can be reduced, and thus the positioning stability of the photosensitive drum driving head can be improved, and consequently more stable power transmission can be achieved.

The invention relates to a driving mechanism of the image forming apparatus, which comprises the photosensitive drum driving head in the embodiment and the driving head 20 for the image forming apparatus in the prior art. The driving head 20 of the image forming apparatus comprises a recess 11, power transmission portions 11*a* and retainer portions 11*b*, wherein the recess 11 is provided with a equilateral triangle cross section; the power transmission portions 11*a* are arranged at three vertex angles of the triangle and have twisted structures; and the retainer portions 11*b* are disposed on three edges of the triangle. In addition, the driving head of the image forming apparatus is connected with a motor in the image forming apparatus for power transmission.

Embodiment 3

Figure 16:
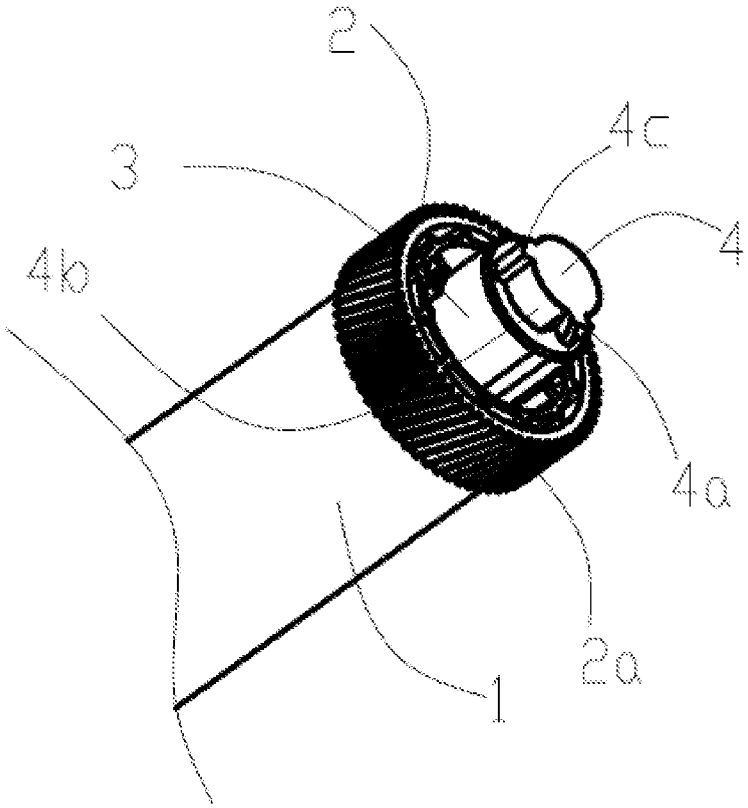
FIG. 16 is a perspective view of a photosensitive drum driving head in an embodiment 3.

It is obvious to those skilled in the art that if in the two convex teeth, one is an oblique tooth and the other is a vertical tooth, the same technical effect can be also achieved. FIG. 16 is a perspective view of a photosensitive drum driving head in the embodiment. As shown in the figure, the oblique tooth 4*a* is obliquely formed on a side wall 4*b* of a boss and the vertical tooth 4*c* is vertically formed on the side wall 4*b*.

Embodiment 4

Figure 17:
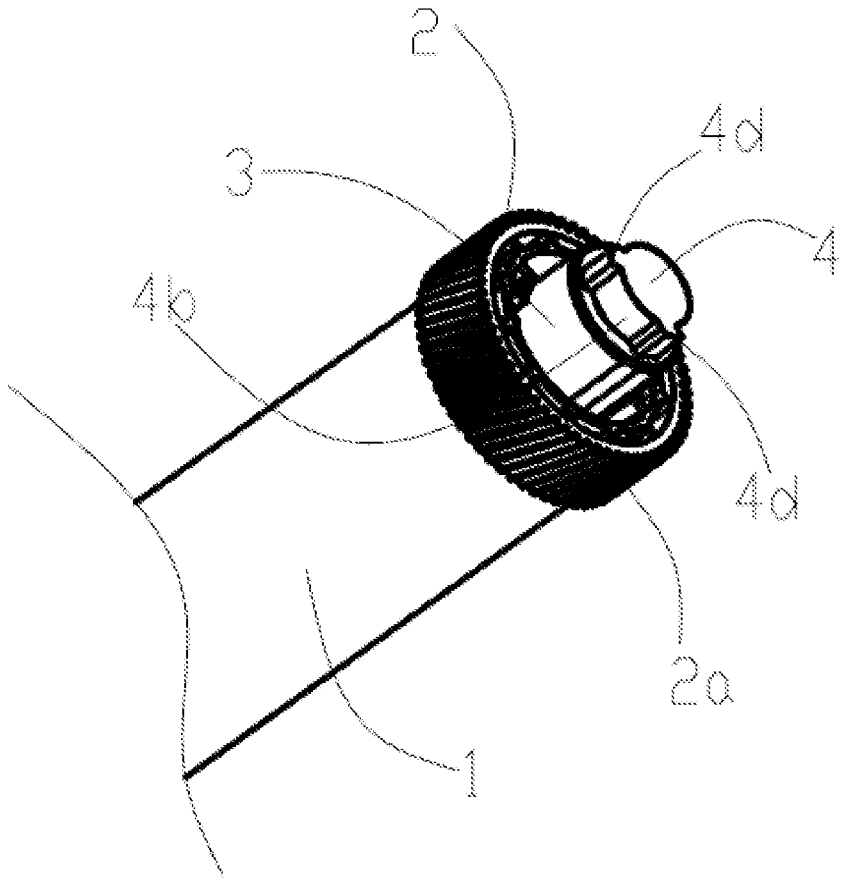
FIG. 17 is a perspective view of a photosensitive drum driving head in an embodiment 4.

When the rotation speed of an image forming apparatus is low and the torsional moment of a driving head of the image forming apparatus is small, both convex teeth of a photosensitive drum driving head may be configured to be vertical teeth. As illustrated in FIG. 17 which is a perspective view of the photosensitive drum driving head in the embodiment, 4*d* refers to the convex teeth of the photosensitive drum driving head. In the embodiment, the manufacturing accuracy of the photosensitive drum driving head is further reduced.

Figure 18:
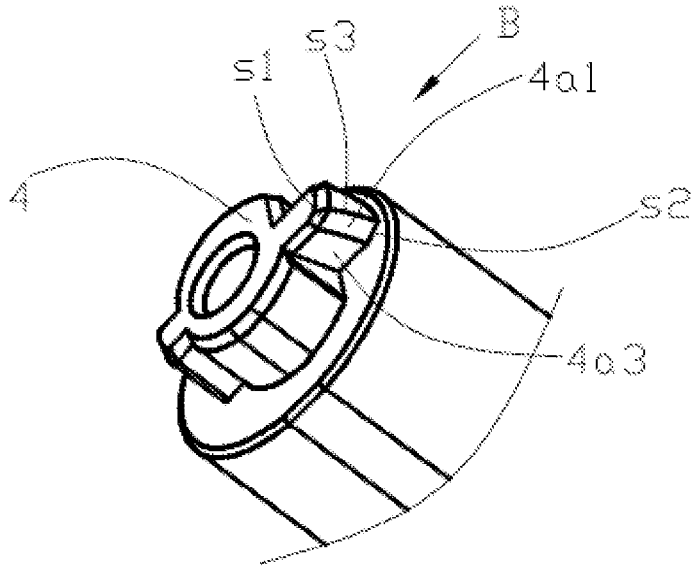
FIG. 18 is a partial enlarged view of a boss for the invention.
Figure 19:
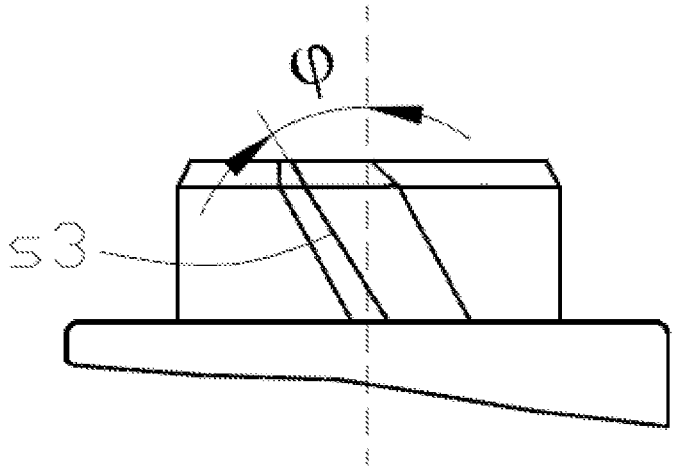
FIG. 19 is a front view of FIG. 18 along the B direction.
Figure 20:
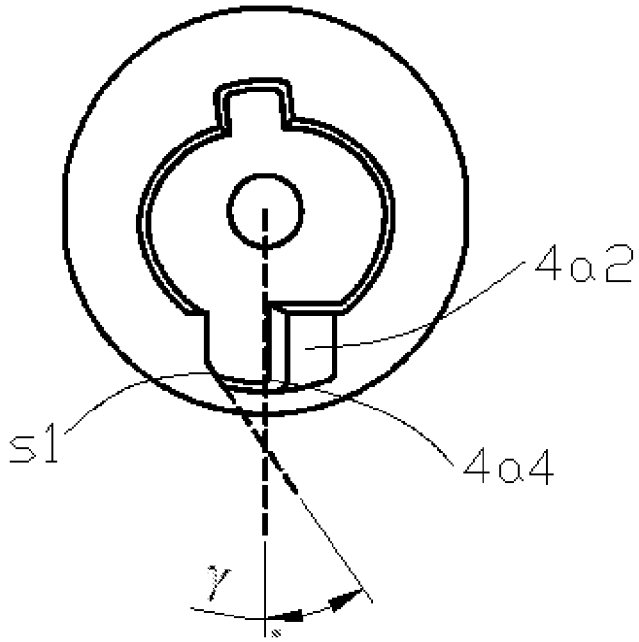
FIG. 20 is a top view of the boss for the invention.

In the invention, the convex teeth 4*a* in the embodiment are also provided with mating surfaces 4*a*1, and the area of the mating surfaces 4*a*1 is between 5 and 20 $mm^2$ and preferably between 7 and 16 $mm^2$ During the power transmission, the mating surfaces 4*a*1 are engaged with inner walls of power transmission portions in the driving head of the image forming apparatus to transmit power. By arrangement of the mating surfaces 4*a*1 on the convex teeth 4*a*, the wear between the photosensitive drum driving head and the driving head of the image forming apparatus can be reduced. Moreover, each convex tooth is also provided with a vertex angle 4*a*4 and two parallel planes 4*a*2 and 4*a*3 connected with a side wall of the convex tooth. In addition, the included angle between the planes 4*a*2 and 4*a*3 and an axial line of a photosensitive drum is β. Furthermore, the mating surfaces are also provided with straight edges s1 and s2 and bevel edges s3, wherein the straight edges s1 and s2 are parallel to each other; the included angle ϕ between the bevel edges s3 and the axial line of the photosensitive drum is between 5 and 50 degrees and preferably between 10 and 40 degrees; and the included angle γ between the straight edges s1 and connecting lines from the center of the photosensitive drum driving head to the vertex angles 4*a*4 of the convex teeth is between 0 and 90 degrees and preferably between 25 and 45 degrees. As illustrated in FIGS. 18 to 20, the "B" direction as shown in FIG. 18 is parallel to the radial extension direction of a boss.

It is apparent to those skilled in the art from the invention that: the convex teeth may also be configured to be three symmetrical convex teeth; the three convex teeth may be all configured to be oblique convex teeth, or all configured to be vertical convex teeth, or with one configured to be an oblique convex tooth and the other two configured to be vertical convex teeth, or with one configured to be a vertical convex tooth and the other two configured to be oblique convex teeth; and the same technical effect can be also achieved. The oblique convex tooth refers to that the convex tooth is obliquely formed on the side wall of the boss, and the vertical convex tooth refers to that the convex tooth is vertically formed on the side wall of the boss.

Moreover, it is apparent to those skilled in the art from the invention that the side wall of the boss and the cylindrical surface of the boss are the same component.

Embodiment 5

A driving head of an image forming apparatus in the embodiment is the same with that in the above embodiment.

Figure 21:
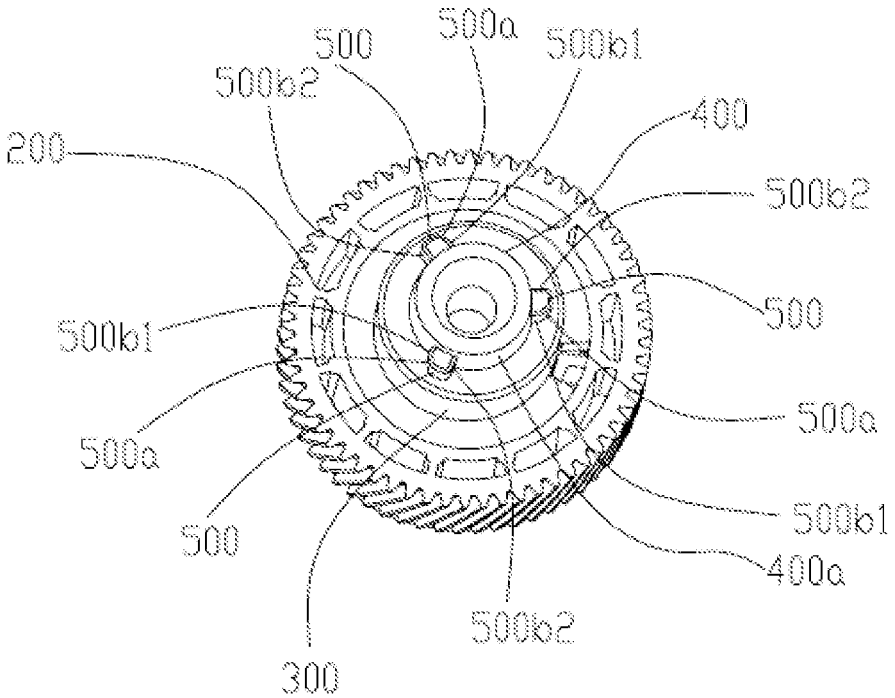
FIG. 21 is a perspective view of a photosensitive drum driving head in an embodiment 5.
Figure 22:
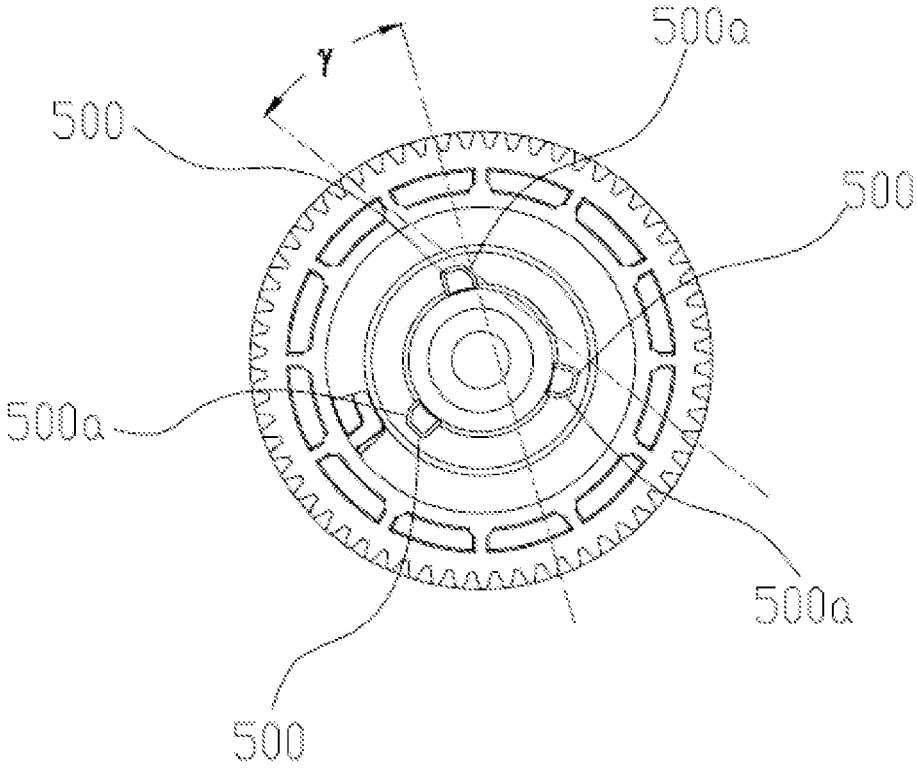
FIG. 22 is a top view of the photosensitive drum driving head in the embodiment 5.

FIGS. 21 and 22 are respectively a perspective view and a top view of a photosensitive drum driving head in the embodiment. The photosensitive drum driving head comprises a drum flange 200, a drum shaft 300, a cylindrical boss 400 and three vertical convex teeth 500, wherein the drum flange 200 is fixedly connected to the end portion of a photosensitive drum 1; the drum shaft 300 is axially extended from the end portion of the drum flange 200 and used for rotationally supporting the photosensitive drum 1 during the operation of a process cartridge; the cylindrical boss 400 is axially extended from the end face of the drum shaft 300 and used for receiving power from the driving head 20 of the image forming apparatus; the three vertical convex teeth 500, which are radially extended along the cylindrical boss 400 and engaged with the power transmission portions 11*a* of the driving head for the image forming apparatus, are formed on a side wall 400*a* of the cylindrical boss 400; the included angle between the vertical convex teeth 500 and an axial line of the photosensitive drum is 0 degree; and the extending length of the cylindrical boss 400 along the axial direction of the photosensitive drum is more than the extending length of the vertical convex teeth 500 along the axial direction of the photosensitive drum.

Figure 23:
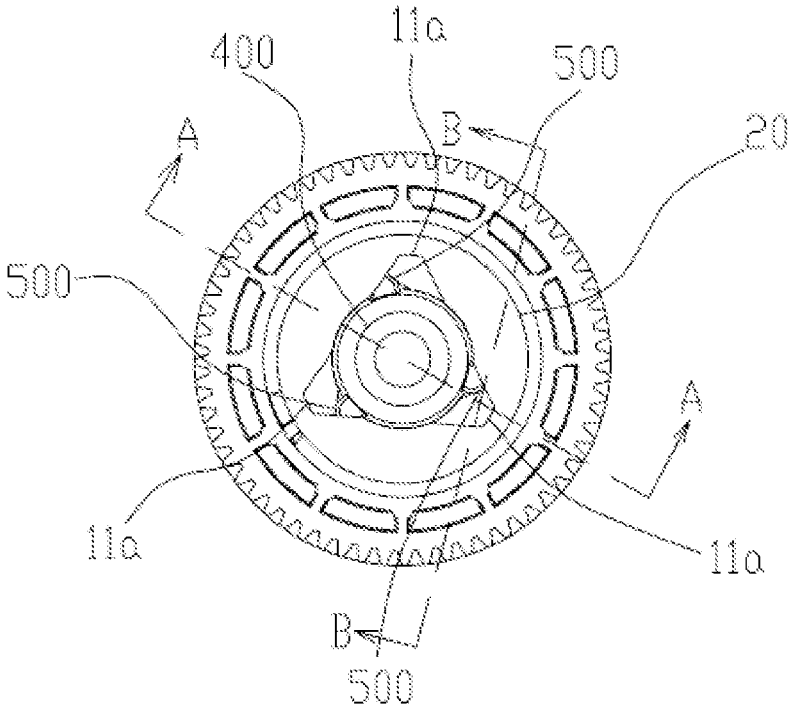
FIG. 23 is a top view illustrating the assembly of the photosensitive drum driving head in the embodiment 5 and the driving head of the image forming apparatus.
Figure 24A:
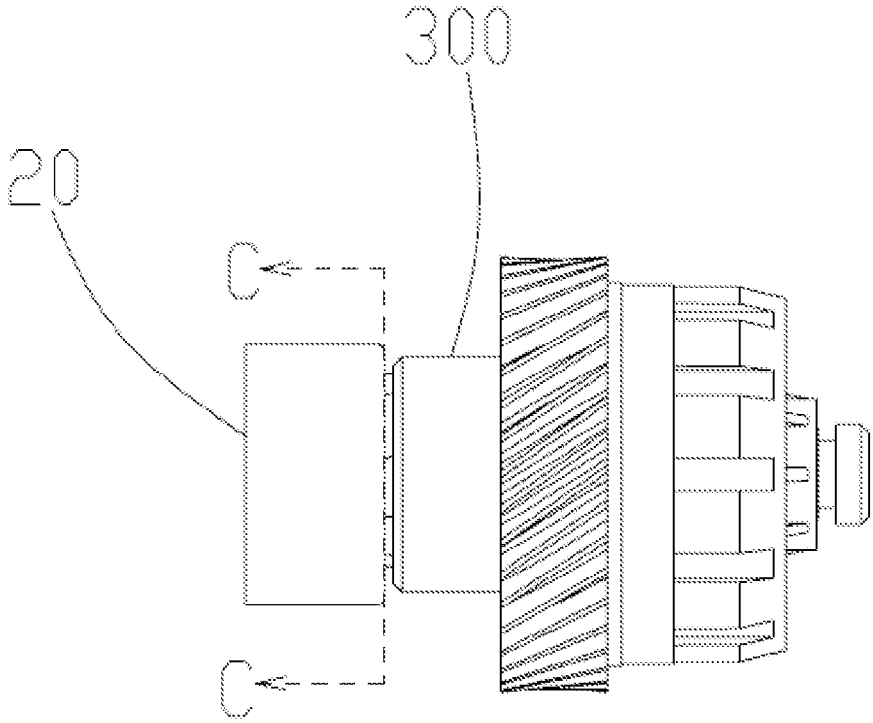
FIG. 24(*a*) is a right view illustrating the assembly of the photosensitive drum driving head in the embodiment 5 and the driving head of the image forming apparatus.
Figure 24B:
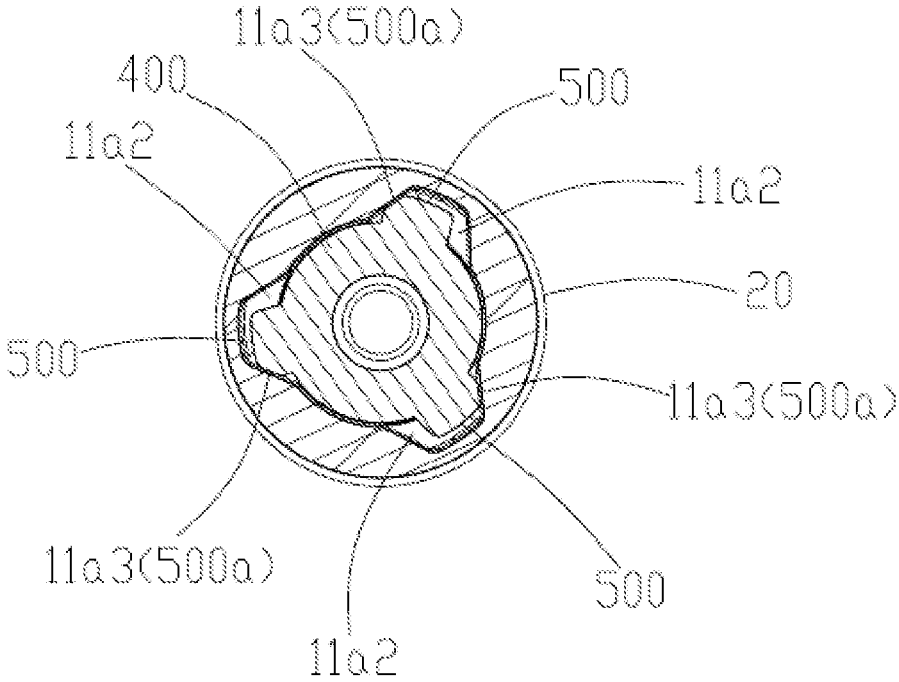
Figure 25:
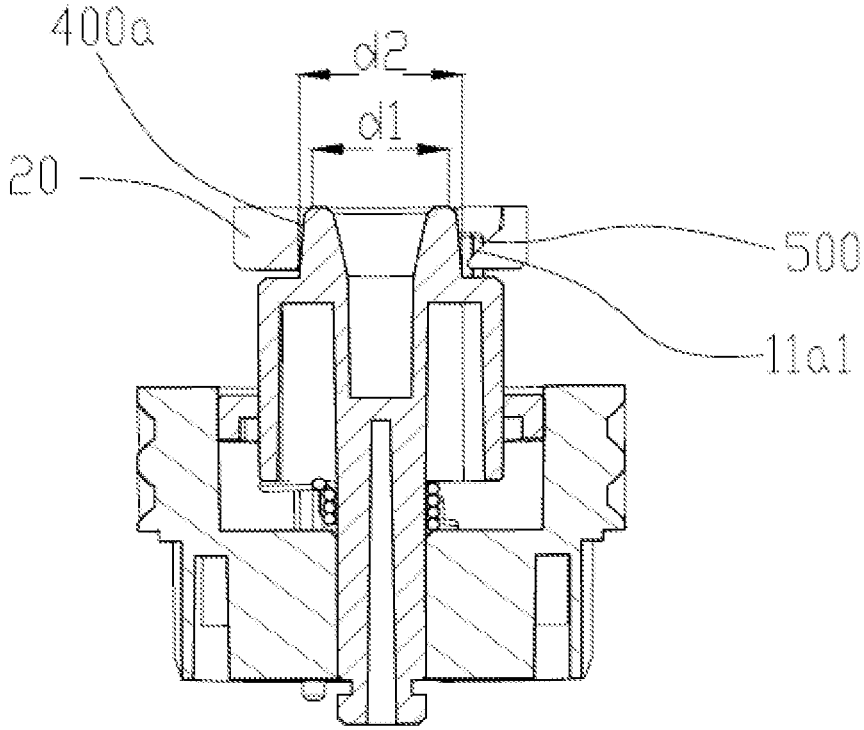
FIG. 25 is a sectional view of FIG. 23 along the A direction.
Figure 26:
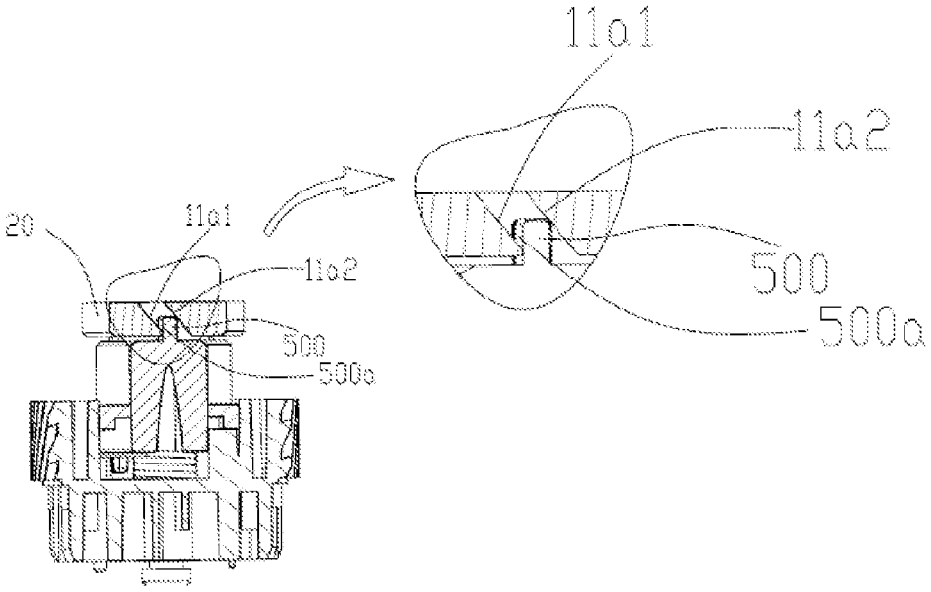
FIG. 26 is a sectional view of FIG. 23 along the B direction.

FIG. 23 is a top view illustrating the assembly of the photosensitive drum driving head and the driving head of the image forming apparatus; FIG. 24(*a*) is a right view illustrating the assembly of the photosensitive drum driving head and the driving head of the image forming apparatus; FIG. 24(*b*) is a sectional view of FIG. 24(*a*) along the C direction; and FIGS. 25 and 26 are respectively a sectional view of FIG. 23 along the A direction and the B direction. As shown in the figures, each vertical convex tooth 500 has a mating surface 500*a*, a first side face 500*b*1 and a second side face 500*b*2, wherein the first side face 500*b*1 and the second side face 500*b*2 are parallel to each other, perpendicular to the end face of the drum shaft 300 and parallel to the axial line of the photosensitive drum; the mating surface 500*a* is perpendicular to the end face of the drum shaft 300 and parallel to the axial line of the photosensitive drum; the chamfer angle γ between the mating surface 500*a* and the first side face 500*b*1 is matched with the obliqueness of the twisted bevel 11*a*1 in the recess 11, so as to increase the contact area when the mating surface 500*a* is engaged with the twisted bevel 11*a*1 for power transmission. The chamfer angle γ is between 0 and 90 degrees and preferably between 20 and 45 degrees, as illustrated in FIGS. 21 and 22. When the vertical convex teeth 500 are engaged with the driving head 20 of the image forming apparatus to transmit the power, the roots of the vertical convex teeth 500 are engaged with edges 11*a*3 (as illustrated in FIGS. 7 and 8) of the twisted bevels 11*a*1, namely one line on each mating surface 500*a* is engaged with the edge 11*a*3 (as illustrated in FIGS. 7 and 8) for power transmission. The area of the mating surfaces 500*a* is between 2 and 20 $mm^2$ and preferably between 3 and 10 $mm^2$, as illustrated in FIGS. 23 and 26. In order to be interposed into the recess 11 more easily, the boss 400 is configured to be conical, namely the outside diameter d1 of a cross-section circle on the end portion of the boss is less than the outside diameter d2 of a cross-section circle at the tail of the boss, as illustrated in FIG. 25. As illustrated in FIG. 26, as the internal structure of the driving head 20 of the image forming apparatus is twisted along a specified direction and the twisted bevels 11*a*1 and the guide bevels 11*a*2 (as illustrated in FIGS. 7 and 8) in the recess 11 are oblique, the width W of the convex teeth 500 interposed into the recess is inversely proportional to the height L of the convex teeth 500, i.e., the greater the width, the smaller the height; the width W of the convex teeth 500 is directionally proportional to the intensity of the convex teeth 500, i.e., the greater the width, the higher the intensity, the smaller the height, and the convex teeth can be more easily disengaged from the recess. The height L is between 1.0 and 8.0 mm and preferably between 2.0 and 4.0 mm, and the width W is between 1.0 and 5.0 mm and preferably between 1.5 and 4.0 mm, so that not only the intensity requirement during the power transmission is met but also a guarantee is made that the convex teeth 500 be not easily disengaged from the recess.

Figure 27:
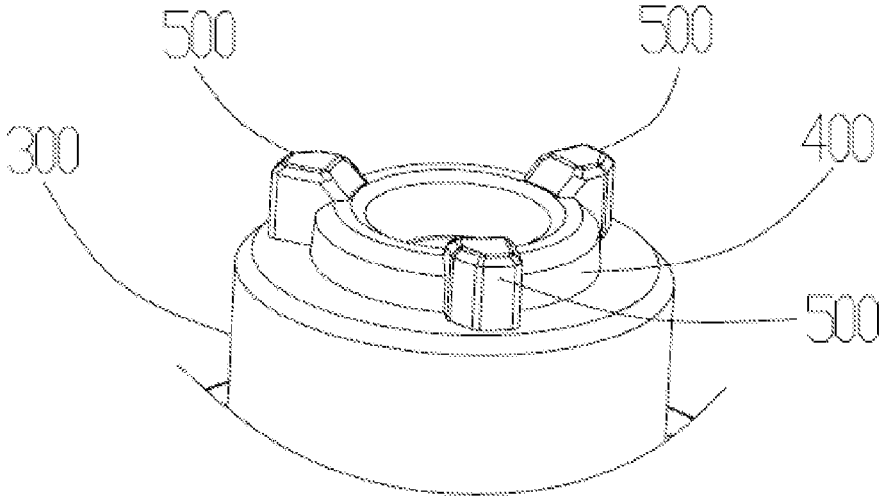
FIG. 27 is a partial structural perspective view of the photosensitive drum driving head, adopting end faces of convex teeth of positioning, in the embodiment 5.

In the embodiment, as illustrated in FIG. 25, the axial positioning between the photosensitive drum driving head and the driving head for the image forming apparatus may be via the contact between the end face of the boss 400 and the bottom surface of the recess 11, and may also be via the contact between end faces of the convex teeth 500 and the guide bevels 11*a*2 in the recess 11 (as illustrated in FIGS. 7 and 8). FIG. 27 is a partial structural perspective view of the photosensitive drum driving head adopting the end faces of the convex teeth for positioning. As shown in the figure, the extending length of the cylindrical boss 400 along the axial direction of the photosensitive drum is less than the extending length of the vertical convex teeth 500 along the axial direction of the photosensitive drum.

The mating surfaces are formed by longitudinal cutting angles on the end faces of the vertical convex teeth, and the longitudinal direction of the vertical convex teeth is parallel to the axial direction of the photosensitive drum.

The roots of the vertical convex teeth are the parts of the vertical convex teeth connected with the end portion of the drum shaft.

Embodiment 6

Figure 28:
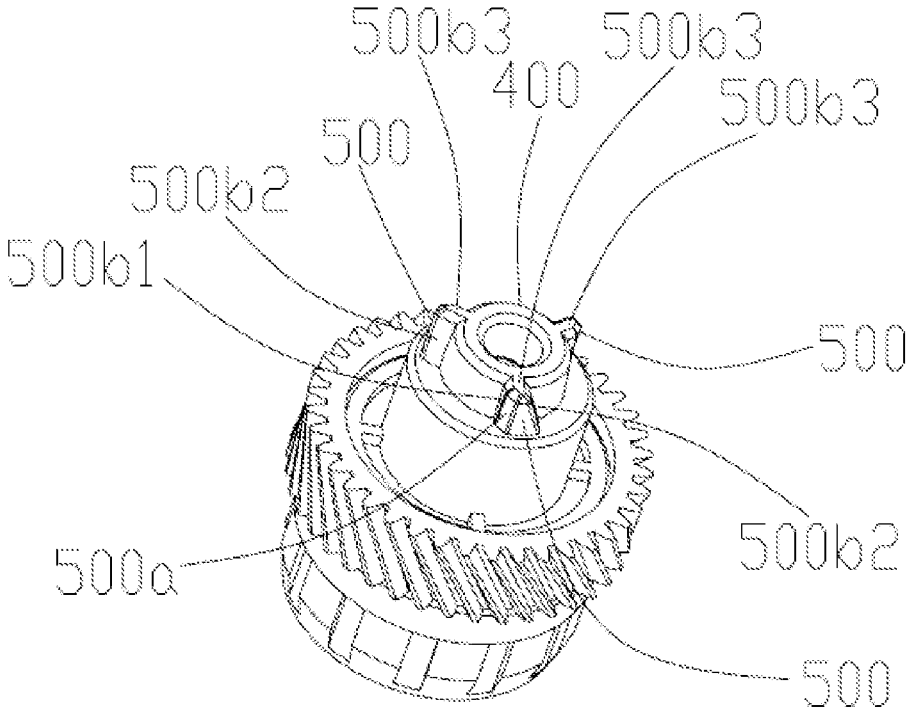
FIG. 28 is a perspective view of a photosensitive drum driving head in an embodiment 6.
Figure 29:
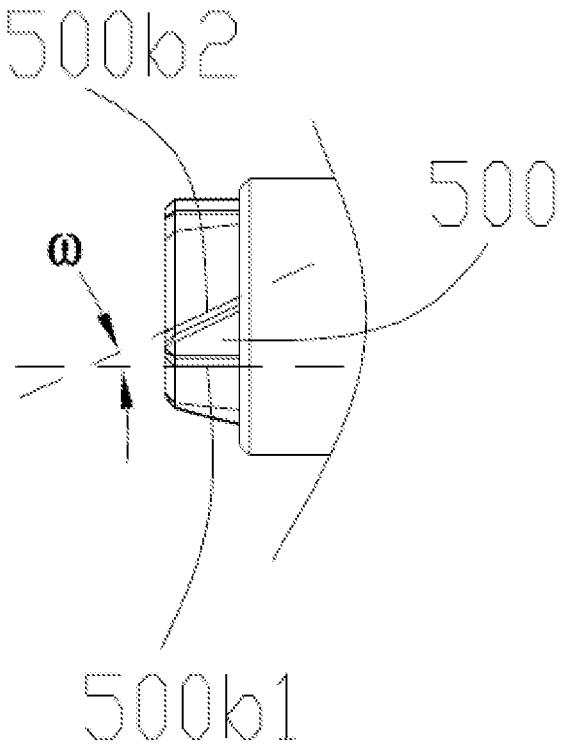
FIG. 29 is a right view of FIG. 28.

FIG. 28 is a perspective view of a photosensitive drum driving head in the embodiment, and FIG. 29 is a right view of FIG. 28. As shown in the figures, the differences between the photosensitive drum driving head in the embodiment and the photosensitive drum driving head in the embodiment 5 are as follows: a second side face 500*b*2 of each vertical convex tooth is configured to a graded bevel gradually varied towards the root of the vertical convex tooth along an end portion 500*b*3 of the vertical convex tooth, and other structures are consistent; and the included angle ω between the second side face 500*b*2 and a first side face 500*b*1 is between 3 and 45 degrees and preferably between 20 and 30 degrees. In the embodiment 5, as the width W of the convex teeth 500 interposed into the recess 11 is inversely proportional to the height L of the convex teeth 500 interposed into the recess 11, the photosensitive drum driving head has the technical problems that: the greater the width W, the higher the intensity of the convex teeth, the smaller the width L, and the convex teeth are more easily to be disengaged from the recess; and in reverse, the smaller the width W, the lower the intensity of the convex teeth, the greater the height L, and the convex teeth are more uneasily to be disengaged from the recess. Moreover, as the roots of the vertical convex teeth 500 are engaged with the edges 11*a*3 of the twisted bevels 11*a*1 in the recess 11 for power transmission (as illustrated in FIG. 26), the intensity requirement on the roots of the vertical convex teeth 500 is high. By adoption of the structure of the second side face 500*b*2 in the embodiment, the above problems can be solved. The reasons are as follows: as the second side face 500*b*2 is a graded bevel gradually varied towards the root of each vertical convex tooth along the end portion of the vertical convex tooth, namely the width of the end portion of the vertical convex tooth 500 is less than the width of the root, the height of the vertical convex tooth interposed into the recess 11 can be increased by the reduction of the width of the end portion of the vertical convex tooth 500, and hence the convex tooth cannot be easily disengaged from the recess; and the intensity of the root can be increased by the increase of the width of the root, so that not only the condition of the height of the vertical convex tooth interposed into the recess can be satisfied but also the intensity of the root of the vertical convex tooth can be increased.

Figure 30:
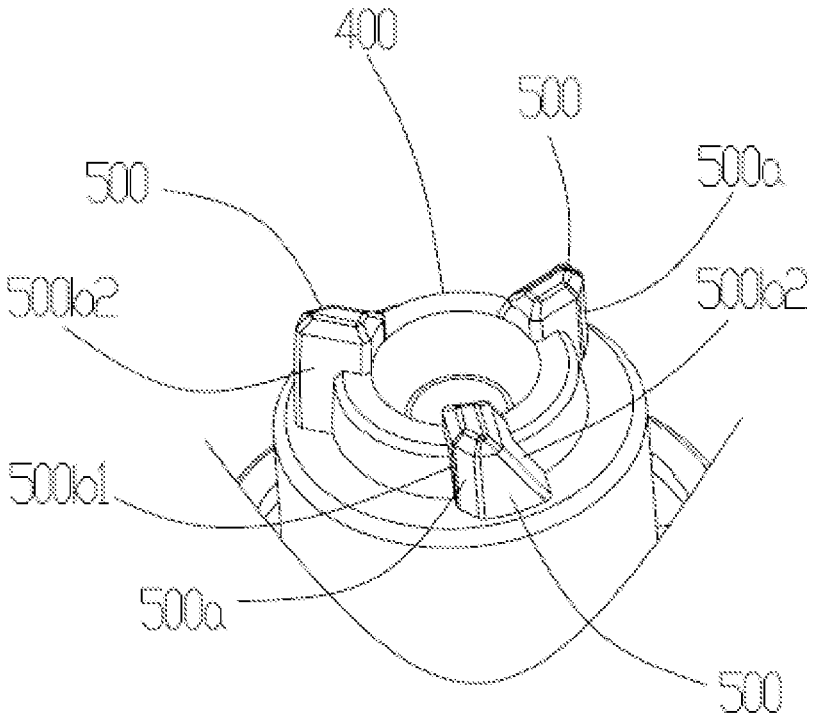
FIG. 30 is a partial structural perspective view of the photosensitive drum driving head, adopting end faces of convex teeth for positioning, in the embodiment 6.
Figure 31:
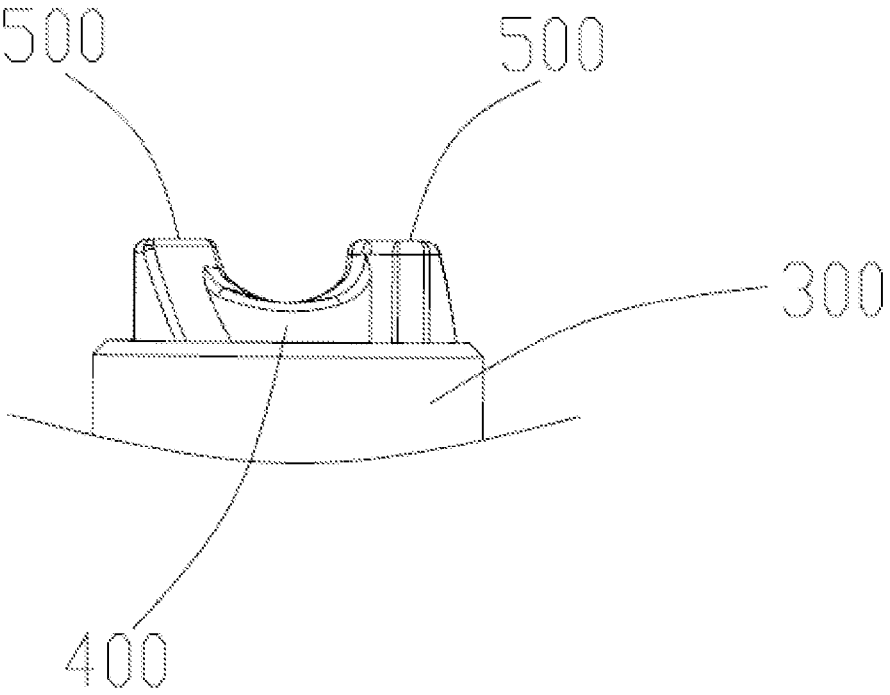
FIG. 31 is a schematic diagram illustrating the state when the vertical convex teeth in the embodiment 6 are connected with each other through a cambered surface.

In the embodiment, the axial positioning between the photosensitive drum driving head and the driving head for the image forming apparatus may be via the contact between the end face of a boss 400 and the bottom surface of the recess 11 and may also be via the contact between end portions 500*b*3 of the vertical convex teeth 500 and the bottom surface of the recess 11 (as illustrated in FIGS. 7 and 8), as illustrated in FIG. 30 which is a partial structural perspective view of the photosensitive drum driving head adopting the end faces of the convex teeth for positioning. As shown in the figure, the extending length of the cylindrical boss 400 along the axial direction of a photosensitive drum is less than the extending length of the vertical convex teeth 500 along the axial direction of the photosensitive drum. FIG. 31 is a schematic diagram illustrating the state when the vertical convex teeth are connected with each other through a cambered surface. As shown in the figure, the end face of the boss 400 among the vertical convex teeth 500 is a cambered surface which is recessed towards the drum shaft, namely the three vertical convex teeth 500 are connected with each other through the cambered surface. Therefore, the stress concentration at joints of the boss and the vertical convex teeth can be reduced, and thus the phenomenon of fracture at the joints of the boss and the vertical convex teeth when the force is applied to the vertical convex teeth can be prevented.

Figure 32:
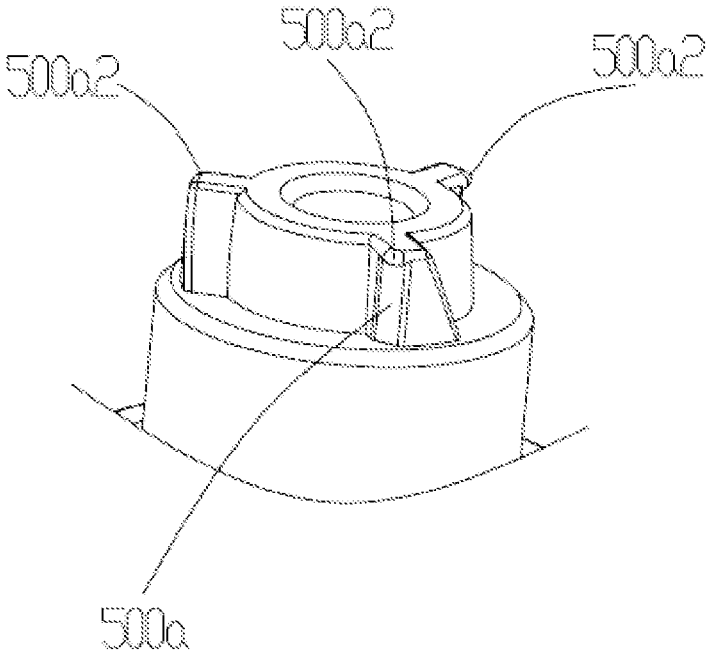
FIG. 32 is a partial structural perspective view of the photosensitive drum driving head provided with non-run portions in the embodiment 6.
Figure 33:
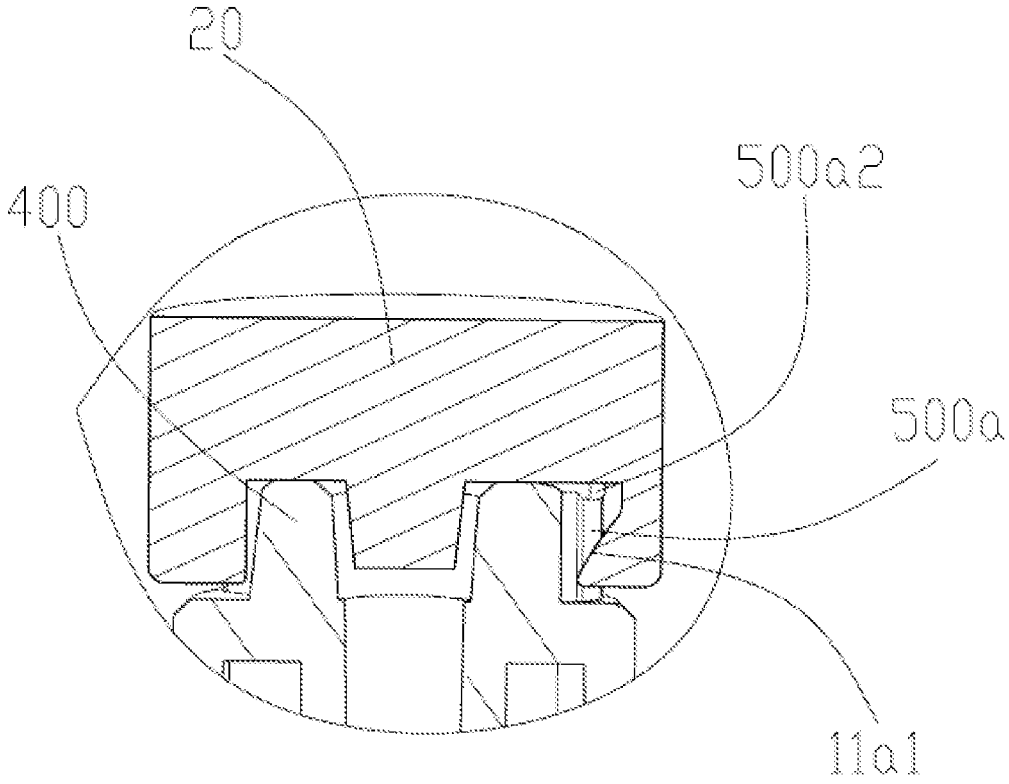
FIG. 33 is a sectional view illustrating the internal structure after the engagement between the driving head of the image forming apparatus and the photosensitive drum driving head provided with the non-run portions in the embodiment 6.

FIGS. 32 and 33 are respectively a partial structural perspective view of the photosensitive drum driving head with non-run portions and a sectional view illustrating the internal structure after the engagement between the photosensitive drum driving head with the non-run portions and the driving head for the image forming apparatus. In order to further solve the problem that the vertical convex teeth can be easily disengaged from the recess, the non-run portions 500*a*2 are formed on mating surfaces 500*a* adjacent to the end faces of the vertical convex teeth. As shown in the figure, the non-run portions 500*a*2 are perpendicular to the mating surfaces 500*a* and extend outwards and are configured to be cambered or semispherical bodies extending outwards from the top of the mating surfaces 500*a*. When the photosensitive drum driving head is engaged with the driving head for the image forming apparatus to transmit power, the non-run portions 500*a*2 may be engaged with the twisted bevels 11*a*1 in the recess 11. If the photosensitive drum driving head tends to the disengaged along the axial direction, the non-run portions 500*a*2 may abut against the twisted bevels 11*a*1 in the recess 11, so that the tension in the axial direction can be produced between the photosensitive drum driving head and the driving head for the image forming apparatus to prevent the photosensitive drum driving head from being disengaged from the driving head for the image forming apparatus.

What is claimed is:

1. A photosensitive drum driving head for a process cartridge of an image forming apparatus, engaged with a driving head of the image forming apparatus for power transmission, the driving head of the image forming apparatus comprising a twisted recess and power transmission portions provided with twisted bevels having edges engaged with the photosensitive drum driving head, the photosensitive drum driving head comprising:

a drum flange disposed on the end portion of a photosensitive drum and connected with the photosensitive drum;

a drum shaft axially extended from the end portion of the drum flange; and a boss axially extended from the end face of the drum shaft and engaged with the twisted recess, wherein at least one convex tooth, radially extended along the boss and engaged with the power transmission portion, formed on the side wall of the boss; and the convex tooth provided with a first side face and a second side face being a graded bevel gradually varied towards the root of the convex tooth along the end portion of the convex tooth;

wherein the convex tooth is provided with a mating surface parallel to an axial line of the photosensitive drum, and the mating surface is engaged with the edge of the twisted bevel in the recess of the image forming apparatus to transmit power.

2. The photosensitive drum driving head according to claim 1, wherein the power transmission portion is also provided with a guide bevel; and when the photosensitive drum driving head is engaged with the power transmission portion for power transmission, the first side face is opposite to an edge of the twisted bevel and the second side face is opposite to the guide bevel on the twisted bevel.

3. The photosensitive drum driving head according to claim 1, wherein the number of the convex teeth is two or more.

4. The photosensitive drum driving head according to claim 3, wherein the convex teeth are connected with each other through a cambered surface.

5. The photosensitive drum driving head according to claim 1, wherein the width of the end portion of the convex tooth is less than that of the root of the convex tooth.

6. The photosensitive drum driving head according to claim 1, wherein the root of the convex tooth is engaged with the edge of the twisted bevel in the recess of the image forming apparatus to transmit power.

7. The photosensitive drum driving head according to claim 1, wherein a non-run portion is disposed on the mating surface adjacent to the end face of the convex tooth, is perpendicular to the mating surface and extends outwards, and is cambered or semispherical in shape.

8. The photosensitive drum driving head according to claim 1, wherein the included angle between the first side face and the second side face is between 20 and 30 degrees.

9. The photosensitive drum driving head according to claim 1, wherein the end face of the boss for the photosensitive drum driving head makes contact with the bottom surface of the recess in the driving head of the image forming apparatus.

10. The photosensitive drum driving head according to claim 1, wherein the end face of the convex tooth for the photosensitive drum driving head makes contact with the bottom surface of the recess in the driving head of the image forming apparatus.

11. The photosensitive drum driving head according to claim 1, wherein the driving head of the image forming apparatus further comprises a curved retainer portion.

12. The photosensitive drum driving head according to claim 1, wherein, when more than one convex tooth is provided, the convex teeth are configured to be all vertical convex teeth of which the first side faces are perpendicular to the end face of the drum shaft, or the combination of at least one vertical tooth which is vertically formed on the side wall of cylindrical boss and at least one oblique tooth which is obliquely formed on the side wall of the cylindrical boss.

* * * * *